US007581536B2

(12) United States Patent
Porter

(10) Patent No.: US 7,581,536 B2
(45) Date of Patent: Sep. 1, 2009

(54) BOW STRING CAPTURE AND RELEASE DEVICE

(76) Inventor: Christopher C. Porter, 2176 E. Brookport St., Covina, CA (US) 91724

( * ) Notice: Subject to any disclaimer, the term of this patent is extended or adjusted under 35 U.S.C. 154(b) by 299 days.

(21) Appl. No.: 11/671,749

(22) Filed: Feb. 6, 2007

(65) Prior Publication Data

US 2007/0181113 A1 Aug. 9, 2007

Related U.S. Application Data

(60) Provisional application No. 60/765,077, filed on Feb. 6, 2006.

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS 4,173,210 A * 11/1979 Napier ..... 124/35.2
4,249,507 A * 2/1981 Marra ..... 124/35.2
4,316,443 A * 2/1982 Giacomo ..... 124/35.2
4,625,705 A * 12/1986 Willits ..... 124/35.2
4,881,516 A * 11/1989 Peck ..... 124/35.2
5,031,600 A * 7/1991 Moore ..... 124/35.2
5,103,796 A * 4/1992 Peck ..... 124/35.2
6,484,710 B1 * 11/2002 Summers et al. ..... 124/35.2
6,584,966 B1 * 7/2003 Summers et al. ..... 124/35.2

* cited by examiner

*Primary Examiner*—John Ricci
(74) *Attorney, Agent, or Firm*—Michael A. Marcelli

(57) ABSTRACT

Described herein is a three stage bow string entrapment and release device. The device is unique and novel in that it incorporates trigger travel amplification such that a movement of X at the trigger results in a movement of approximately 1.5X at the critical release surface. Further, by mechanically disconnecting the trigger travel from the release surface, this device eliminates the perception of creep and allows the archer to focus on his or her target and not anticipate the breaking point of the release.

6 Claims, 5 Drawing Sheets

BOW STRING CAPTURE AND RELEASE DEVICE

RELATED APPLICATIONS

Not Applicable.

STATEMENT REGARDING FEDERALLY FUNDED RESEARCH

Not Applicable.

BACKGROUND AND BRIEF DESCRIPTION OF THE INVENTION

The present invention deals generally with the field of archery bow string release aids, (although one skilled in the art could adapt the basic design for other uses, such as the fire control system of a firearm). Such release aids are well established in the art and are generally intended to serve two essential functions: to alleviate strain on the archery's fingers while drawing and holding the bow and to provide an accurate, repeatable, mechanism for releasing the bowstring. In other words, these devices are generally intended to permit the archer to concentrate on his intended target, while being able to ignore the mechanical aspects of releasing the bow string.

Archery release aids are well established in the art, and take on various forms. There are releases that rely upon holding and releasing the nock of the arrow. See, e.g., Maxwell, U.S. Pat. No. 1,542,159 and Cook, U.S. Pat. No. 4,151,825. Others rely upon pivoting or clamping jaws to hold and release the bow string. See, e.g., Vogel, et. al., U.S. Pat. No. 5,067,472; Greene, Jr. U.S. Pat. No. 5,020,508; Lyons, U.S. Pat. No. 4,282,851 and U.S. Pat. No. 4,407,260. Other devices use a variety of triggers, sears, cams, and a variety of mechanical motions to achieve the desired results. See, e.g., Gazzara, Sr. U.S. Pat. No. 3,948,243; Scott, U.S. Pat. No. 4,036,204; Peck, U.S. Pat. No. 4,881,516 and U.S. Pat. No. 5,103,796; and Summers, US Appl. No. 20040079351. However, the bow string releases presently available do not achieve the ease of use and consistency required for the archer to achieve the utmost accuracy. It is the purpose of this invention to overcome the deficiencies found in the prior art devices and to provide an archery release of superior accuracy and repeatability.

The present invention accomplishes its purpose using three improvements over the prior art. First, the device's design eliminates the sear commonly found in existing designs. As described further herein, eliminating the sear and mechanically disconnecting the movement of the trigger from the second stage cam, the sensation of "creep," i.e., the physical sensation of the sear dragging across its engagement surface prior to firing, is eliminated. Eliminating the sensation of creep allows the archer to concentrate on his or her target and not on the movement of the release's trigger.

Second, the preferred embodiment of the design of the first and second stage of the trigger results in trigger travel amplification. That is, a movement of X of the first stage trigger (FIG. 1 (3B)) results in a movement of approximately 1.5× at the terminus of the second stage trigger cam (FIG. 1 (6B)). Again, by minimizing the physical movement required to release the bowstring, the more the archer can concentrate on his or her target, and not on the movement of the trigger.

Finally, this invention allows for an infinitely adjustable trigger pull. The archer, by changing springs (FIG. 1 (9)) and the amount of tension placed upon those springs by spring retention screw (FIG. 1 (10)) can vary the trigger pull from a few ounces to several pounds. Thus, this design will accommodate a wide range of shooting styles, including those shooters who prefer shooting with back tension.

BRIEF DESCRIPTION OF THE SEVERAL VIEWS OF THE DRAWINGS

FIG. 1 represents a horizontal cross sectional view of the device showing its internal and external components: (1) Trigger Cylinder; (2) Trigger Cylinder Location Holes; (3) Stage One Trigger Lever; (3A) Stage One Trigger Lever/Stage Two Cam Interface; (3B) Stage One Trigger Lever Upper Arm; (3C) Trigger Lever Return Spring Interface; (4) Stage One Pivot Post; (5) Optional Trigger Lever Return Spring; (6) Stage Two Cam; (6A) Stage Two Cam/Stage One Trigger Lever Interface; (6B) Stage Two Cam/Firing Pin Interface (7) Stage Two Cam Pivot Post; (8) Trigger Travel Adjustment Screw; (9) Trigger Tension Spring; (10) Trigger Tension Adjustment Screw; (11) Housing (see also FIGS. 2A and 2B); (11E) Flipper Locking Tab Engagement Recess; (12) Firing Pin Spring; (13) Firing Pin; (13A) Stage Two Cam Engagement Recess; (13B) Stage Three Cam Actuation Slot; (14) Stage Three Cam; (14A) Return Spring Retention Slot; (14B) Stage Three Cam/Flipper Abutment; (14C) Stage Three Cam Actuation Surface; (14D) Stage Three Cam Trapping Surface; (15) Flipper; (15A) Flipper/Stage Three Cam Interface; (15B) Flipper Locking Tab; (16) Flipper Pivot Post; (17) Release Rope Holes; (18) String Entrapment Hole; (19) Stage Three Cam Post; (20) Stage Three Cam Return Spring.

FIG. 2A and FIG. 2B represent prospective views of the left and right halves of the preferred embodiment's housing, respectively, and detailing the (3D) Trigger Lever Housing Recesses; (4A) Stage One Pivot Post Recesses; (6C) Stage Two Cam Recesses; (7A) Stage Two Cam Pivot Recesses; (10A) Trigger Tension Adjustment Screw Housing; (11A) Finger Grooves; (11B) Housing Fastener Holes; (11C) Firing Pin Spring Housings; (11D) Third Stage Cam Capture Surfaces; (13C) Firing Pin Races; (14E) Stage Three Cam Recesses; (15C) Flipper Recesses; (16A) Flipper Pivot Post Recesses; and (19A) Stage Three Cam Pivot Post Recesses.

FIG. 3 represents a plan layout view detailing the relative dimensions of the device's preferred embodiment. This drawing also illustrates the device's trigger travel amplification ability, in that the length of the radius from the tangential intersection point of the first stage trigger lever and the second stage cam (B=0.638) divided by the length of the radius of intersection of the tangent the trigger cylinder to the center of the trigger lever pivot (A=0.974) times the ratio of the distance from the second stage cam/firing pin interface (D=0.543) to the radius from the tangential intersection point of the second stage cam and the first stage trigger lever to the center of second stage pivot (C=0.239) is approximately 1.5.

FIG. 4.

FIG. 5: FIG. 5A illustrates the embodiment in which the area over the archer's index finger is open and his or her third and fourth fingers grip the device at the remaining two finger grooves. The archer's pinky finger does not grip the device in this embodiment. FIG.

5B illustrates the embodiment in which the area over the archer's index finger is open and all of his or her remaining fingers grip the device. FIG. 5C illustrates the embodiment in which the area over the archer's index finger is enclosed within a ring and all of his or her remaining fingers grip the device. FIG. 5D illustrates the embodiment in which the area over the archer's index finger is enclosed within a ring and his or her third and fourth fingers grip the device at the remaining two finger grooves.

DETAILED DESCRIPTION OF THE INVENTION

Figure 1:
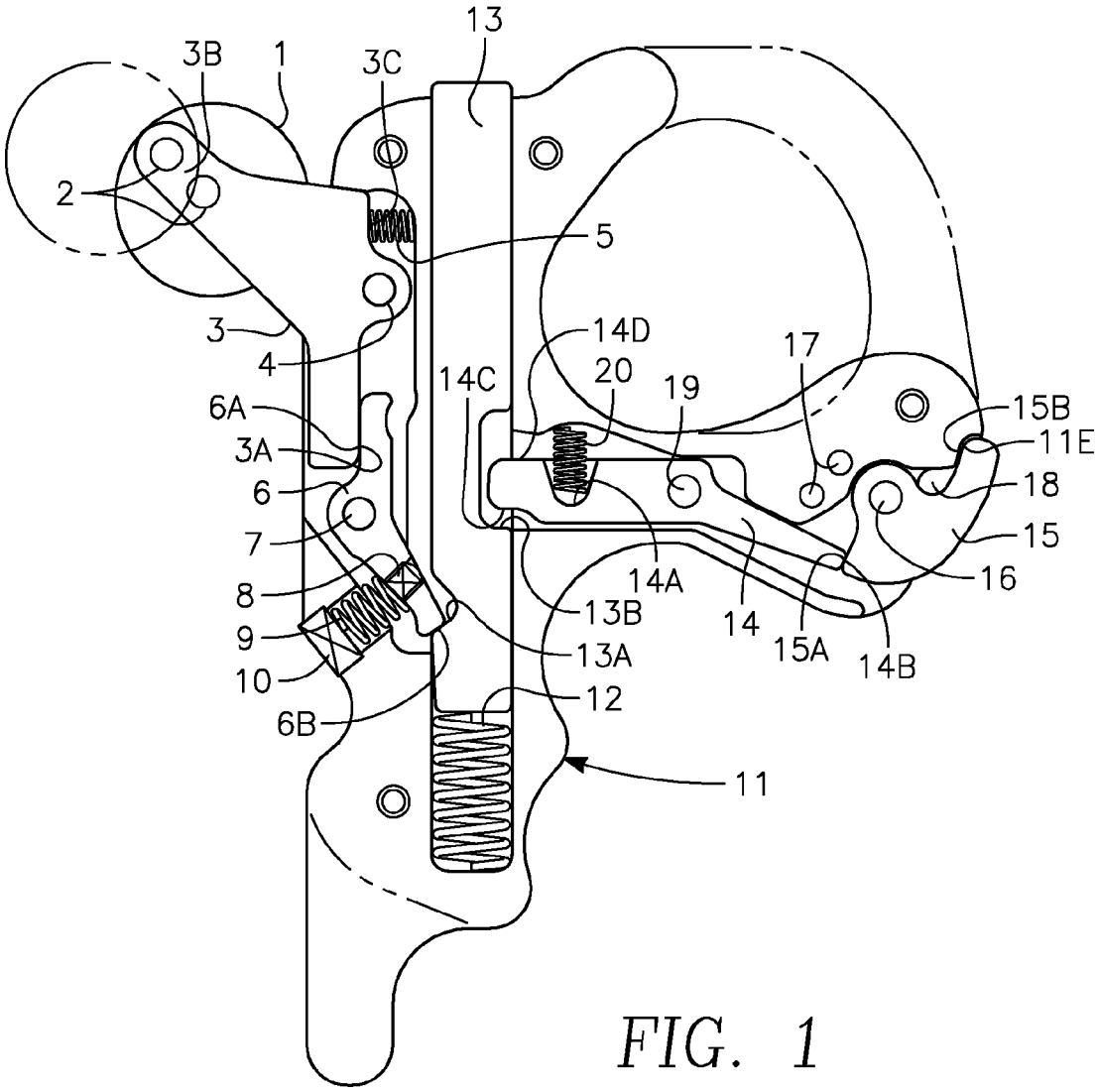
FIG. 1.
Figure 2A:
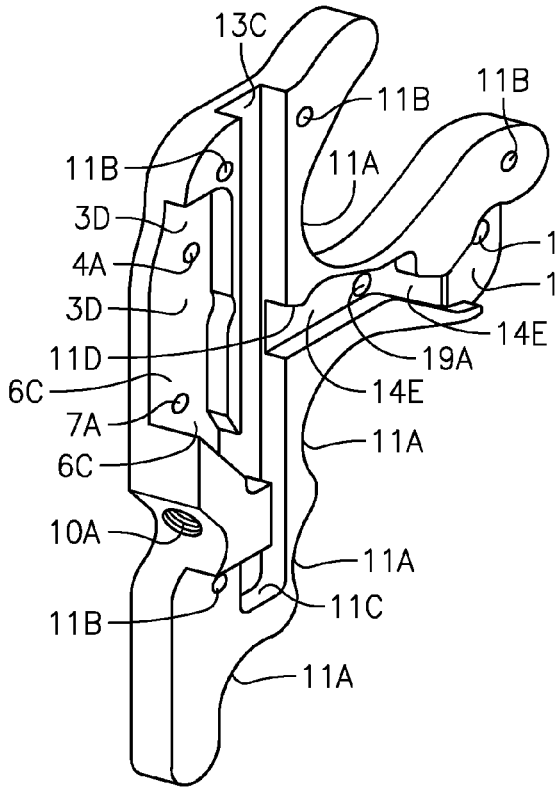
FIG. 2A and FIG. 2B.
Figure 2B:
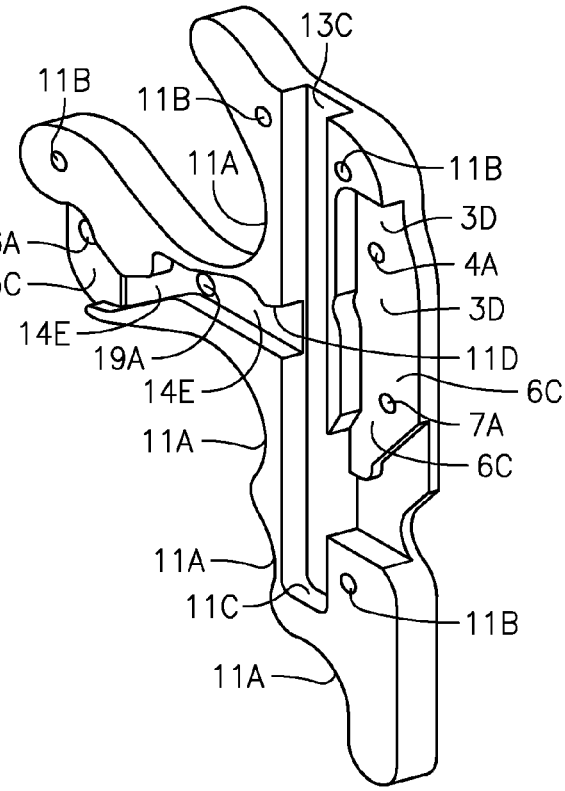

This invention is generally comprises a three stage bow sting capture and release mechanism (See FIGS. 1 and 3) encased within a two piece housing (FIGS. 2A, 2B). Hereinafter, all numbers shall refer to FIG. 1, unless otherwise noted. Viewing the invention externally, it is comprised of a top, bottom, front, back and left and right sides. As referred to herein, the top of the device shall refer generally to the surface of the device from which the firing pin (13) protrudes when the device is not cocked. The bottom shall refer to the area of the device opposite the top. The front shall refer generally to the surface of the device where the flipper (15) is located and the rear shall refer to the area from which the upper arm of the stage one trigger lever (3B) protrudes from the housing.

As detailed in FIG. 1, the first stage is generally comprised of three parts: the trigger cylinder (1); the stage one trigger lever (3); and the stage one pivot post (4). (Note: In some embodiments, an optional trigger lever return spring (5), may be positioned on the front surface of the trigger lever, behind the pivot post (3C) as a stage one component. While not critical to the functioning of the release, the trigger return spring (5) tends to keep the internal pieces of the release from rattling). The stage one trigger lever (3) and stage one pivot post (4) are housed within their respective recesses (3D) and (4A) in the devices' housing. (See FIGS. 2A and 2B (3D) and (4A), respectively).

The trigger cylinder (1) is a partially hollow cylinder having a solid base. The solid base of the trigger cylinder is threaded and tapped near its outer circumference to accept a screw. The screw is used to attach the trigger cylinder to the stage one trigger lever (3) using one of the two trigger cylinder location holes (2) on the upper arm of the trigger lever (3B). The trigger cylinder (1) is ambidextrous and may be mounted on either face of the upper arm of the stage one trigger lever (3B) depending upon whether the archer is right or left handed. The two location hole choices (2) and eccentrically rotatable trigger cylinder (1) provide the archer with a wide variety of ergonomic options that permit the archer to focus on his or her intended target and not upon the function of the release. The solid and dashed lines in FIG. 1 (1) represent two different axial orientations of the trigger cylinder.

The first stage trigger lever (3) is a solid angled lever containing three holes. Two of these holes, the trigger cylinder location holes (2) are located on the upper arm of trigger lever (3B). The third hole, which is located approximately at the midpoint of the trigger lever (3), serves as the pivot point. A hardened post (4) passes through the trigger lever at its approximate midpoint and seats within recesses in the release's housings when assembled (See FIGS. 2A and 2B (4A), thereby holding the trigger lever (3) in place within its own recesses in the housings (FIGS. 2A and 2B (3D)).

The second stage is generally comprised of four parts: the stage two cam (6); the stage two cam pivot (7); the trigger travel adjustment screw (8); a removable/replaceable trigger tension spring (9); and trigger tension adjustment screw (10). The second stage cam (6) is an angled bar with a centrally located pivot hole through which the stage two cam pivot post (7) passes. This hardened pivot post (7) extends though the pivot hole and into recesses in the release's housings (FIGS. 2A and 2B (7A)) holding the second stage cam in place within the cam's own recesses in the housings (FIGS. 2A and 2B (6C)). The lower arm of the stage two cam has a threaded hole that houses the trigger travel adjustment screw (8). The trigger travel adjustment screw (8) adjusts the amount of cam engagement at the interface of the lower arm of the second stage cam and the recess (13A) in the rear face of the firing pin (13). The trigger tension spring (9), the weight of which is selectable by the user, is housed directly above and collinear with the trigger travel adjustment screw (8) and bears against the lower arm of the second stage cam. The trigger tension spring (9) is held in place by the trigger tension adjustment screw (10), which screw is housed within a threaded hole in one half of the housing's release. (See, FIG. 2 (10A)) By turning the trigger tension adjustment screw (10) inward or outward, the archer can vary the amount of tension on the second stage cam, and thus the force required to be placed on the trigger cylinder (1) to disengage the second stage cam engagement surface (6B) from the stage two cam engagement recess (13A) and thus to release the bowstring.

Figure 4A:
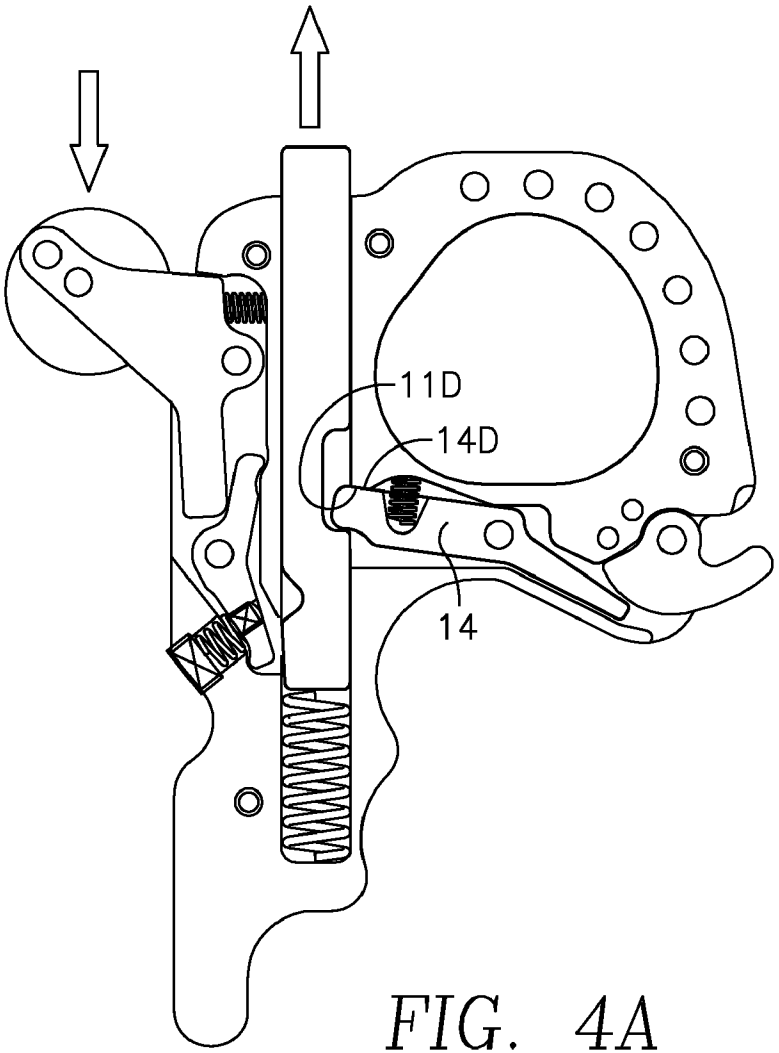
FIG. 4A depicts an embodiment of the device in its fully fired position. The drawing emphasizes how the design of the third stage cam prevents movement of the firing pin once the string has been released by the interaction of the Stage Three Cam Trapping Surface (14D) and the Third Stage Cam Trapping Surfaces (11D).
Figure 4B:
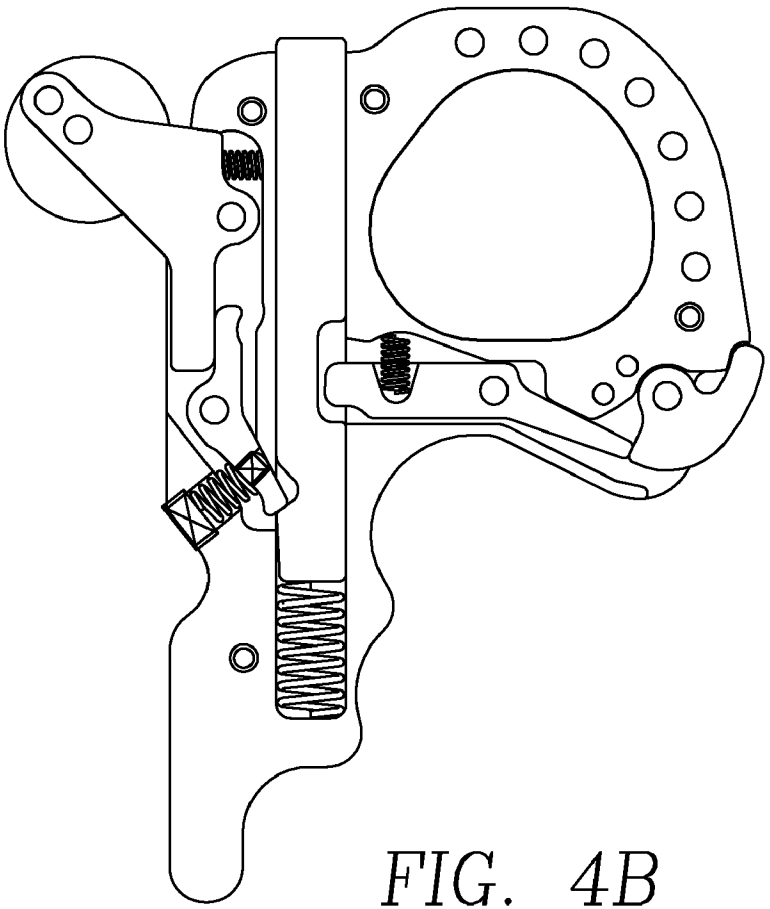
FIG. 4B depicts an embodiment of the device in its cocked and unfired position.

The first and second stage are not mechanically interconnected, however, the lower front surface of the trigger lever (3A) bears against the upper rear surface of the second stage cam (6A). Thus, applying a downward force to the trigger cylinder causes the lower arm of the trigger lever (3A) to rotate counterclockwise and the lower arm of the second stage cam (6B) to rotate clockwise away from the stage two engagement recess in the firing pin (13A). FIGS. 4A and 4B illustrate the internal workings of the device in its fired and cocked and unfired states, respectively.

The stage one trigger lever and stage two cam are designed such that a counterclockwise movement of X at the trigger cylinder (1) results in a clockwise movement of approximately 1.5× at the interface of the stage two cam (6B) and the firing pin recess (13A). In the preferred embodiment, (See, FIG. 3), the ratio of distance from the center of the stage one pivot post (4) to the tangent intersection point of the first stage trigger lever (3A) and the second stage cam (6A) (See also, FIG. 3, (B)) and the tangent of the upper surface of the trigger cylinder (1) to the center of the stage one pivot post (4) (See also, FIG. 3, (A)) (B/A) multiplied by the ratio of the distance from the interface of the second stage cam (6B) to the second stage pivot (7) (See also, FIG. 3, (D)) and the distance between the center pivot of the second stage cam (7) and the tangent intersection point of the first stage trigger lever (6A) (See, also FIG. 3, C) (D/C) is approximately 1.5.

$$(B/A)*(D/C)\approx 1.5.$$

Figure 3:
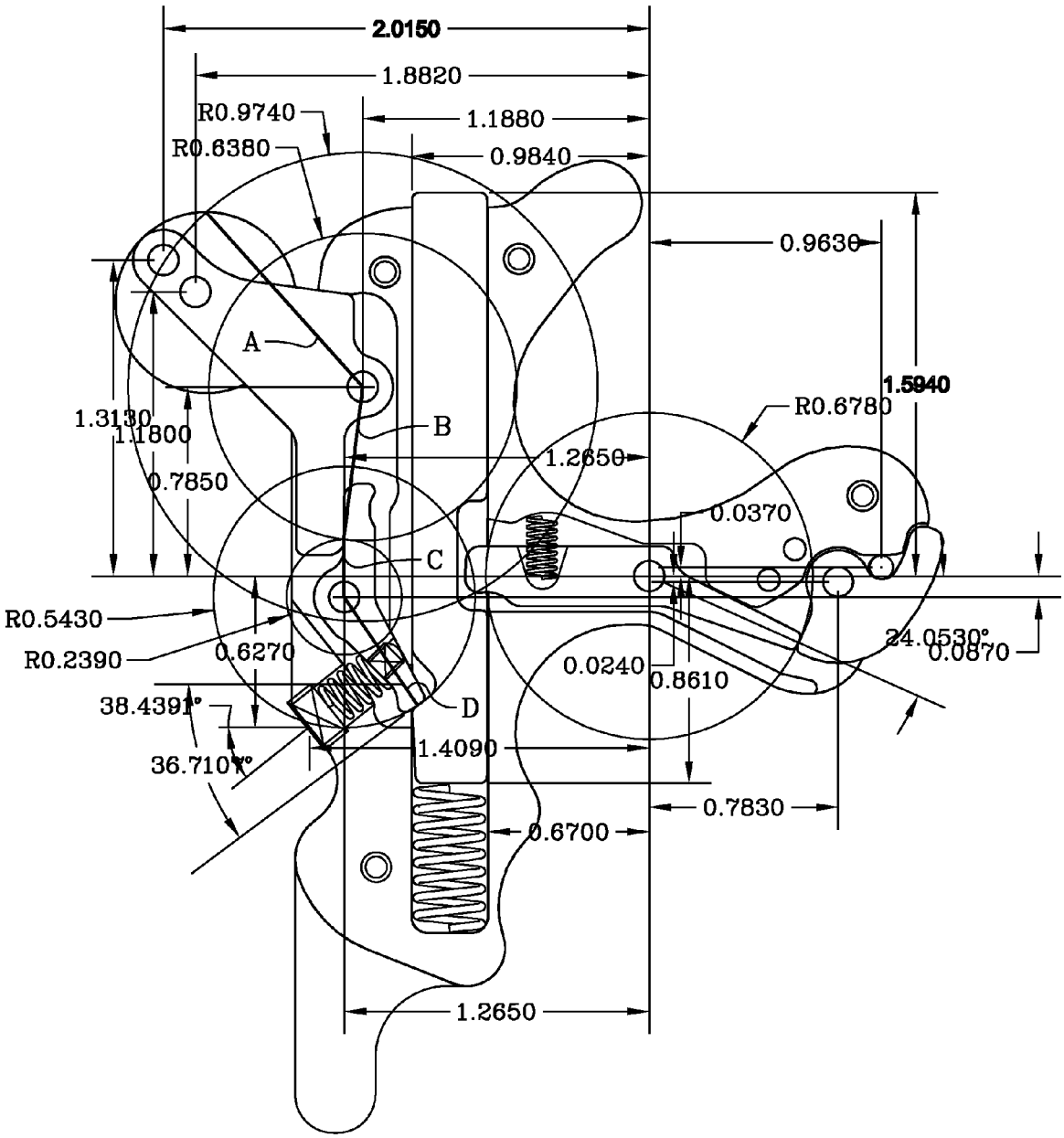
FIG. 3.

In the preferred embodiment, which design is detailed in FIG. 3, A equals 0.974", B equals 0.638", C equals 0.239" and D equals 0.543". The benefit of this design over that of a typical sear is that the movement of the trigger is minimized (which in turn minimizes the possibility of anticipating the "break" of the trigger) while cam/firing pin engagement, and hence safety, is maximized. Of course an infinite number of combinations lengths and angles are possible, as are an infinite number of possible amplification values. All such iterations should be considered part of this unique, useful and novel design.

It should also be noted that in addition to maximizing the movement of the second stage cam engagement surface (6B) while minimizing the movement of the trigger cylinder (1), this design also mechanically disconnects the movement of the cam (6B) at the firing pin recess (13A) from the movement of the trigger lever (3) and in so doing, eliminates the perception of trigger "creep" associated with releases utilizing a sear.

Finally, the third stage is generally comprised of nine parts: the firing pin (13); the firing pin spring (12); the stage three cam (14); the stage three cam pivot (19); the stage three cam engagement spring (20) the flipper (15); the flipper pivot post (16); and the bowstring entrapment hole (18), which entrapment hole is created when the flipper locking tab (15B) mates with its corresponding recess on the outer face of the housing (11E).

The firing pin (13) is a rectangular bar. The bar rests within a vertical recess machined or molded into the release's housing (See, FIG. 2, (13C)) and, except as described herein, is free to move up and down within the housing. The rear surface of the firing pin is recessed (13A) to accept the lower arm of the second stage cam (6B). When the top of the firing pin, which extends outside the surface of the housing (11) in its unfired position (See, FIG. 4A), is depressed and the firing pin spring (12), which spring is trapped between the bottom of the firing pin (13) and the solid bottom of the firing pin spring housing (11C), is compressed, the device is "cocked." See, e.g., FIG. 4B. (Note: The flipper is shown in its fully closed position in FIG. 4B. Cocking the firing pin alone does not rotate the flipper into this position. As described herein, the flipper must be manually rotated counterclockwise to achieve the fully closed position).

The front surface of the firing pin also contains a recess (13B). To maintain the structural integrity of the firing pin and assure proper functioning of the release, the front recess (13B) is located above the rear firing pin recess (13A). As described below, the front firing pin recess (13B) serves two important functions. It transfers the firing pin's energy from its lower surface (13B) to the bottom of the rear arm of the third stage cam (14C) during the firing process and also prevents it the firing pin from exiting the device after the string is released. See, FIG. 4A The third stage cam (14) is a long angled beam that extends from the front recess in the firing pin (13B) to the flipper (15). A pivot post (19) located at the approximate middle of this beam, and extending into recesses in the release's housings (FIG. 2, (19A)), holds the cam (14) in place within the stage three cam's housing's recesses (14E) and provides a rotation axis for the cam. A recess within the rear arm the stage three cam (14A) houses a light weight stage three cam return spring (20). When the firing pin is cocked, the stage three cam return spring (20) exerts a downward force on the rear arm of the cam. Thus, when the flipper (15) is rotated counterclockwise to its fully closed position (See FIG. 4B), the stage three cam return spring's (20) downward force causes the front arm of the stage three cam (14B) to rise and lock the flipper closed (15A).

The flipper (15) is housed within recesses in the device's housings (FIGS. 2A and 2B (15C)), and held in position by the flipper pivot post (16), which flipper pivot post (16) extends though the pivot hole in the flipper (15) and into recesses in the release's housings (FIGS. 2A and 2B (16A)). When the flipper (15) is rotated counterclockwise to its fully closed position, the flipper tab (15B) mates with a corresponding recess on the housing (11E), and forms the string entrapment hole (18).

Figure 5A:
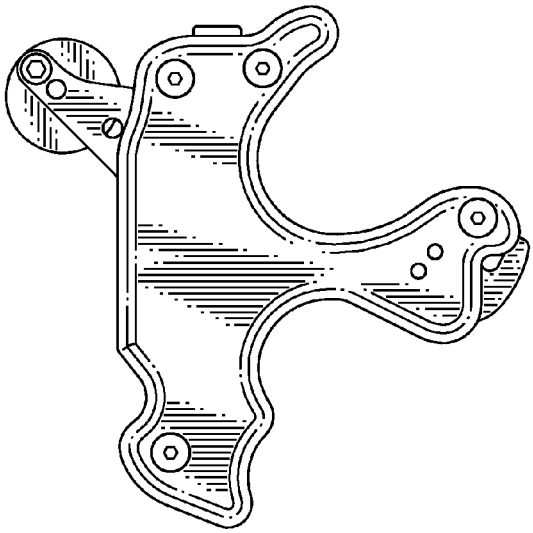
FIGS. 5A through 5D illustrate various embodiments of the device having differing housings.
Figure 5B:
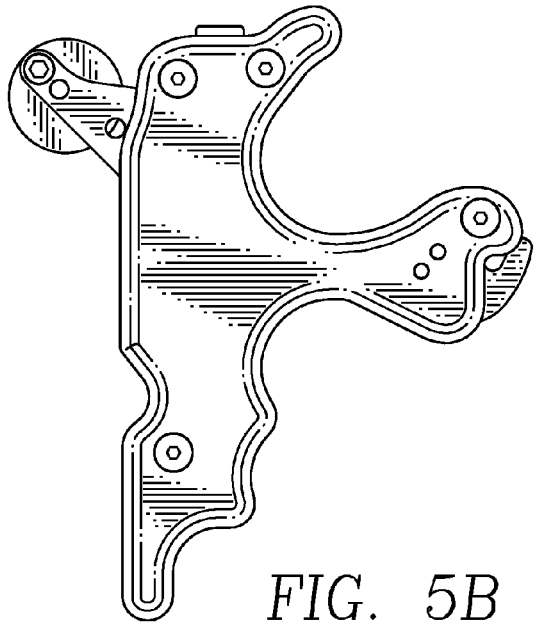
Figure 5C:
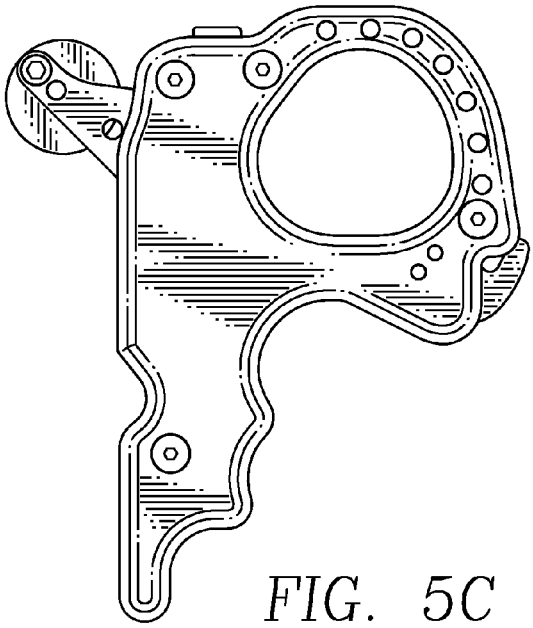
Figure 5D:
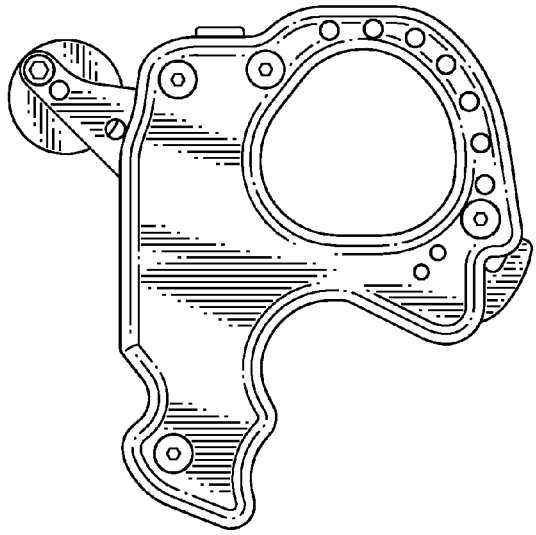

The components of the three stages are encased in two molded, cast or machined housings which are detailed in FIGS. 2A and 2B. These housings may be held together by screws, rivets or adhesive, with screws (FIGS. 2A and 2B (11B)) being the preferred mode of attachment. The external appearance of the housing may be varied to accommodate different archer's shooting styles and ornamental and esthetic preferences. See FIGS. 5A though 5D. The most notable variation of these preferences being the addition or subtraction of finger grooves (FIGS. 2A and 2B (11A)) from the housing (11).

For ease of manufacture, the interior layout and dimensions of the housings remain substantively constant irrespective of their external design. Additionally, while not necessary to the functioning of the device, each embodiment has two release rope holes (17) positioned behind the bow string entrapment recess (18) formed by the walls of the housing (11E) and the flipper tab (15B) when closed. These holes (17) permit an archer who prefers shooting a rope release to thread on end of the rope release through one hole, tie it off, and thread the opposite end of the rope through the opposite side of the remaining hole and tie it off to create the necessary loop. Finally, all components described herein are machined and/or cast metal, preferably steel or brass, with the exception of the housings, which may be machined from aluminum or injection molded plastic.

Of course, it should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed covered by this invention.

Method of Use:

To use the release, it must first be cocked by holding the release vertically in the intended shooting hand and depressing the firing pin (13) with the shooting hand's thumb until the lower arm of the second stage cam (6B) engages the recess in the rear of the firing pin (13A). An audible click will be heard when the cam (6B) engages the firing pin recess (13A) and the firing pin will remain depressed. See FIG. 4B.

Next, one of three means must be used to capture the bow string in the recess formed between the release's housing and the flipper (15). This recess shall be referred to hereinafter as the bow string entrapment recess (18). First, the bow string may be directly placed in the bow string entrapment recess (18) and the flipper rotated counterclockwise to entrap the bowstring. Another audible click will be heard when the flipper is rotated to its fully locked position and the front arm of the third stage cam (14B) locks the flipper (15) into its closed position. While some experienced archers use this method of operation, it is discouraged because it tends to weaken the bow string and could cause injury to the shooter or his or her equipment if the bow string fails.

Second, for bow strings having a "D loop" attached, the D loop is threaded into the bow string entrapment recess and the flipper is rotated counterclockwise to entrap the string as described above.

Finally, should the archer wish to do so, a loop may be treaded though the loop holes (17) of located proximate to the bow string entrapment recess (18). To capture the bowstring using this method, the archer encircles the bowstring with the loop, then threads the loop through the bow string entrapment recess on the release and then rotates the flipper to capture the loop.

Once one of the three means for capturing the bowstring is used to capture the string, the bow is drawn by the archer to full draw. Depending upon the shooting style of the archer, he or she can then either press upon the top surface of the trigger cylinder to release the string or adjust the tension on the release such that the tension exerted by the archer's thumb on the trigger cylinder when the bow is brought to full draw causes the bowstring to be released without any additional voluntary movement on the part of the archer.

When sufficient pressure is placed upon the trigger cylinder (1) to overcome the user selectable spring pressure applied to the second stage cam (6B) by the trigger tension spring (9) and trigger tension adjustment screw (10), the second stage cam (6B) disengages from the rear firing pin recess (13A). The firing pin spring (12) drives the firing pin (13) upward causing the lower, interior surface of the stage three cam actuation slot (13A) on the front of the firing pin to contact the lower rear portion of the stage three cam (14C) with sufficient force to overcome the stage three cam return spring (20) and cause the stage three cam to rotate in a clockwise direction. When the front arm of the stage three cam (14B) rotates a sufficient amount, the base of the flipper (15A) is free to rotate in a clockwise direction and the bowstring is released from the bow string entrapment recess (18).

The firing pin continues to move upward in its recess (FIGS. 2A and 2B (13C)) until the top portion of the rear arm of the stage three cam (14D) contacts the housing surface (FIGS. 2A and 2B (11D)) which halts further movement of the rear arm of the stage three cam and the firing pin (13).

I claim:

1. A bow string capture and release device comprising:

a three stage mechanism encased within a two half housing, said housing comprising separate recesses to accept each of the component parts of said three stage mechanism;

said two halves being held together by screws, rivets or adhesive;

said first stage further comprising a trigger lever; said trigger lever further comprising upper and lower arms; and a pivot post; said trigger lever being partially pivotally rotatable about said pivot post within its recess;

said second stage comprising a second stage cam; said second stage cam further comprising upper and lower arms; a pivot post; said second stage cam being partially pivotally rotatable about said pivot within its recess; and a trigger tension spring; said trigger tension spring arranged so as to apply tension to the lower arm of said second stage cam;

said third stage comprising a firing pin; said firing pin farther comprising top, bottom, front and rear surfaces; said front and rear firing pin surfaces having engagement recesses; a firing pin spring; said firing pin spring engaging the bottom surface of said firing pin and applying upward force thereupon; a third stage cam; said third stage cam further comprising front and rear arms; a third stage cam pivot post; said third stage cam being partially pivotally rotatable about said pivot post within its recess; a third stage cam return spring; a flipper; and a flipper pivot; said flipper partially pivotally rotatable about said pivot post within its recess; said flipper further comprising front and rear surfaces;

said first, second and third stage components being spatially arranged such that the lower arm of the trigger lever contacts the upper arm of the second stage cam; said lower arm of said second stage cam rotatably engages and disengages within said rear recess firing pin recess; said rear arm of said third stage cam rotatably engages said front firing pin recess and said front arm of said third stage cam rotatably engages said rear surface of said flipper.

2. A bow string capture and release device comprising:

a three stage mechanism encased within a two half housing, said housing comprising separate recesses to accept each of the component parts of said three stage mechanism and two release rope holes; said two halves being held together by screws, rivets or adhesive;

said first stage further comprising a trigger lever and a pivot post; said trigger lever, further comprising upper and lower arms; said trigger lever being partially pivotally rotatable about said pivot post within its recess;

said second stage comprising a second stage cam; a pivot post; said second stage cam further comprising upper and lower arms; said second stage cam being partially pivotally rotatable about said pivot within its recess; and a trigger tension spring; said trigger tension spring being located behind and applying pressure said lower arm of said second stage cam;

said third stage comprising a firing pin; said firing pin having front, rear, top and bottom surfaces; said front firing pin surface having a stage three cam actuation slot and said rear firing pin surface having a stage two cam engagement recess; said firing pin being partially movable within its recesses; a firing pin spring; said firing pin spring being contained with in a recess in said housing halves and the bottom of said firing pin; a third stage cam; a third stage cam pivot post; said third stage cam further comprising front and rear arms; said third stage cam being partially pivotally rotatable about said pivot post within its recess; a third stage cam return spring; said third stage cam return spring applying downward pressure to said rear arm of said third stage cam; a flipper; and a flipper pivot; said flipper partially pivotally rotatable about said pivot post within its recess; said flipper further comprising front and rear surfaces;

said first, second and third stage components being spatially arranged such that the lower arm of the trigger lever contacts the upper arm of the second stage cam; said lower arm of said second stage cam rotatably engages and disengages within said stage two cam engagement recess; said rear arm of said third stage cam rotatably engages said stage three cam actuation slot and said front arm of said third stage cam rotatably engages said rear surface of said flipper.

3. A bow string capture and release device comprising:

a three stage mechanism encased within a two piece housing, said housing comprising recesses to accept the components of said three stage mechanism;

said first stage further comprising a trigger lever and a pivot post, said trigger lever pivotally mounted between said housing halves; said trigger lever further comprising upper and lower arms; said upper arm further comprising two trigger cylinder location holes; said lower arm further comprising a front and rear surface; and a trigger cylinder attached to said trigger lever via a screw through one of the two trigger cylinder location holes;

said second stage comprising a second stage cam, a second stage cam pivot post, said second stage cam being pivotally mounted within a recess between said housing halves, a trigger engagement screw; a trigger tension spring and a hollow trigger tension adjustment screw;

said second stage cam further comprising an upper arm and a lower arm; said upper arm further comprising a front and rear surface; said lower arm further comprising a firing pin engagement surface and a threaded screw receptacle; said lower arm threaded receptacle housing said trigger engagement screw;

said trigger tension spring being coaxially mounted with said trigger engagement screw and said hollow trigger tension adjustment screw; said hollow trigger tension adjustment screw being located within a threaded recess within one of the two housing halves;

said trigger lever and second stage cam being spatially located within said housing halves such that the front lower arm of the trigger lever tangentially rests against the rear upper arm of the second stage cam;

said third state comprising a firing pin, said firing pin being retained within a recess between said housings; said firing pin further comprising top, bottom, front and rear surfaces; said rear surface further comprising a second stage cam engagement recess; said lower arm of said second stage cam rests within said second stage cam engagement recess when the device is cocked; said front surface further comprising a stage three cam actuation slot; a firing pin spring; said firing pin spring being contained between the recess described by the bottom surface of the firing pin and the firing pin housing recess;

a third stage cam, a third stage cam pivot post, said third stage cam being pivotally mounted within recesses between said housing halves; said third stage cam further comprising front and rear arms; said rear arm extending into said stage three cam actuation slot; said rear arm farther comprising a third stage cam return spring recess; a third stage cam return spring; said third stage cam return spring housed within said third stage cam return spring recess; and a flipper, said flipper being pivotally mounted within recesses between said housing halves, said flipper having front and rear surfaces, said rear surface of said flipper abutting said stage three front arm.

4. A bow string capture and release device as described in claim 3, wherein said trigger cylinder is a partially hollow cylinder having a solid bottom; said solid bottom being drilled and tapped on near its outer radial surface.

5. A bow string capture and release device as described in claim 3, wherein the ratio of the distance between the tangential interface of the trigger lever and second stage cam and the trigger lever pivot post and the trigger lever pivot post to the upper surface of the trigger cylinder times the ratio of the distance from the tangential interface of the trigger lever and second stage cam to the second stage cam pivot and the second stage cam engagement surface and the second stage pivot, is approximately 1.5.

6. A bow string capture and release device as described in claim 3, wherein a trigger return spring is mounted between the front surface of the trigger lever and the trigger lever housing recess and above the trigger pivot post.

* * * * *